US012644676B2

(12) United States Patent
Groff et al.

(10) Patent No.: US 12,644,676 B2
(45) **Date of Patent: *Jun. 2, 2026**

(54) MAGAZINE INTERPOSER FOR A CONDUCTED ELECTRICAL WEAPON

(71) Applicant: Axon Enterprise, Inc., Scottsdale, AZ (US)

(72) Inventors: John Groff, San Francisco, CA (US); Trevor Ryan, Tahoe City, CA (US); Arturo Meuniot, San Francisco, CA (US); Michael Roberts, San Francisco, CA (US)

(73) Assignee: Axon Enterprise, Inc., Scottsdale, AZ (US)

( * ) Notice: Subject to any disclaimer, the term of this patent is extended or adjusted under 35 U.S.C. 154(b) by 175 days.

This patent is subject to a terminal disclaimer.

(21) Appl. No.: 18/404,567

(22) Filed: Jan. 4, 2024

(65) Prior Publication Data

US 2024/0295388 A1 Sep. 5, 2024

Related U.S. Application Data

(63) Continuation of application No. 17/837,981, filed on Jun. 10, 2022, now Pat. No. 11,920,903.

(60) Provisional application No. 63/209,766, filed on Jun. 11, 2021.

(51) Int. Cl.
*F41H 13/00* (2006.01)

(52) U.S. Cl.
CPC ..... *F41H 13/0025* (2013.01)

(58) Field of Classification Search
CPC ..... F41H 13/0025; F41H 13/0031; F41H 13/0018; F42B 5/025
USPC ..... 361/232
See application file for complete search history.

(56) References Cited

U.S. PATENT DOCUMENTS

| | | | |
|---|---|---|---|
| 2,926,566 | A | 3/1960 | Atkins et al. |
| 5,831,199 | A | 11/1998 | Mcnulty, Jr. et al. |
| 6,877,434 | B1 | 4/2005 | Mcnulty, Jr. |
| 7,950,176 | B1 | 5/2011 | Nemtyshkin et al. |
| 7,950,329 | B1 | 5/2011 | Nemtyshkin et al. |
| 8,342,098 | B2 | 1/2013 | Shalev et al. |
| 8,733,251 | B1 | 5/2014 | Abboud et al. |

(Continued)

FOREIGN PATENT DOCUMENTS

| | | | |
|---|---|---|---|
| CN | 207351302 | U | 5/2018 |
| CN | 108444337 | A | 8/2018 |

(Continued)

OTHER PUBLICATIONS

USPTO, Corrected Notice of Allowance for U.S. Appl. No. 17/837,981 mailed Jan. 23, 2024.

(Continued)

*Primary Examiner* — Sreeya Sreevatsa
(74) *Attorney, Agent, or Firm* — Justin Powley

(57) ABSTRACT

A conducted electrical weapon may include an interposer. The interposer may be disposed in a bay of the conducted electrical weapon or may be coupled to a magazine insertable within the bay of the conducted electrical weapon. The interposer may include a cartridge separator. The cartridge separator may logically or physically define a plurality of cartridge compartments. Each cartridge compartment may be configured to receive and align with a cartridge loaded into a magazine.

20 Claims, 8 Drawing Sheets

(56) References Cited

U.S. PATENT DOCUMENTS

| | | | | |
|---|---|---|---|---|
| 10,066,905 | B2 | 9/2018 | Heroor et al. | |
| 10,161,722 | B1 | 12/2018 | Salisbury et al. | |
| 10,168,127 | B1 | 1/2019 | Salisbury et al. | |
| 10,598,467 | B1 | 3/2020 | Mcdermit et al. | |
| 10,627,195 | B2 | 4/2020 | Nerheim et al. | |
| 10,731,953 | B2 | 8/2020 | Petrovic et al. | |
| 11,041,698 | B2 | 6/2021 | Nemtyshkin et al. | |
| 11,530,903 | B2 | 12/2022 | Burke et al. | |
| 2006/0207466 | A1 | 9/2006 | Mcnulty et al. | |
| 2010/0050856 | A1 | 3/2010 | Baldwin | |
| 2010/0275806 | A1 | 11/2010 | Gavin et al. | |
| 2014/0098453 | A1* | 4/2014 | Brundula | F41H 5/24 361/232 |
| 2015/0002981 | A1 | 1/2015 | Klug et al. | |
| 2017/0059661 | A1 | 3/2017 | Foldyna | |
| 2018/0283829 | A1 | 10/2018 | Petrovic et al. | |
| 2019/0128650 | A1* | 5/2019 | Kim | F41H 13/0025 |
| 2019/0154409 | A1 | 5/2019 | Heroor et al. | |
| 2020/0109933 | A1 | 4/2020 | Brundula et al. | |
| 2020/0158475 | A1* | 5/2020 | Salisbury | F41H 13/0025 |
| 2020/0278182 | A1 | 9/2020 | Salisbury et al. | |
| 2022/0082357 | A1 | 3/2022 | Smith et al. | |
| 2022/0228841 | A1 | 7/2022 | Smith et al. | |

FOREIGN PATENT DOCUMENTS

| | | | | |
|---|---|---|---|---|
| KR | 20180032364 | A | 3/2018 | |
| KR | 20180060294 | A | 6/2018 | |
| KR | 101872709 | B1 | 7/2018 | |
| KR | 101890759 | B1 * | 8/2018 | F41B 15/00 |
| RU | 2275576 | C1 | 4/2006 | |
| RU | 68671 | U1 | 11/2007 | |
| RU | 2351871 | C1 | 4/2009 | |
| RU | 2477441 | C1 | 3/2013 | |
| RU | 2480704 | C2 | 4/2013 | |
| RU | 2526159 | C2 | 8/2014 | |
| RU | 2527242 | C2 | 8/2014 | |
| RU | 2648562 | C1 | 3/2018 | |
| TW | 202113301 | A | 4/2021 | |
| TW | 202136705 | A | 10/2021 | |
| WO | 20090025575 | A1 | 2/2009 | |
| WO | WO-2012128670 | A2 * | 9/2012 | F41H 13/0025 |
| WO | 2018111140 | A1 | 6/2018 | |
| WO | 2021002922 | A2 | 1/2021 | |
| WO | 2021101604 | A1 | 5/2021 | |

OTHER PUBLICATIONS

Taiwanese Patent Office, Allowance Decision of Examination for Taiwanese Application No. 111121715 mailed Aug. 24, 2023.

Taiwan Intellectual Property Office, Search Report for Taiwan Application No. 111121715 completed Nov. 28, 2022.

Korean Intellectual Property Office, International Search Report for International Application No. PCT/US2022/032975 mailed Sep. 30, 2022.

European Patent Office, Extended European Search Report for European Patent Application No. 22821093.6 mailed Mar. 10, 2025.

Taiwan Intellectual Patent Office, Allowance Decision of Examination for Taiwanese Application No. 112145482 mailed Apr. 29, 2024.

Intellectual Property Office of Singapore, Invitation to Respond to Written Opinion for Singapore Patent Application No. 11202309361Q, mailed Sep. 12, 2025.

* cited by examiner

MAGAZINE INTERPOSER FOR A CONDUCTED ELECTRICAL WEAPON

FIELD OF THE INVENTION

Embodiments of the present disclosure relate to a conducted electrical weapon ("CEW").

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the following illustrative figures. In the following figures, like reference numbers refer to similar elements and steps throughout the figures.

Figure 1:
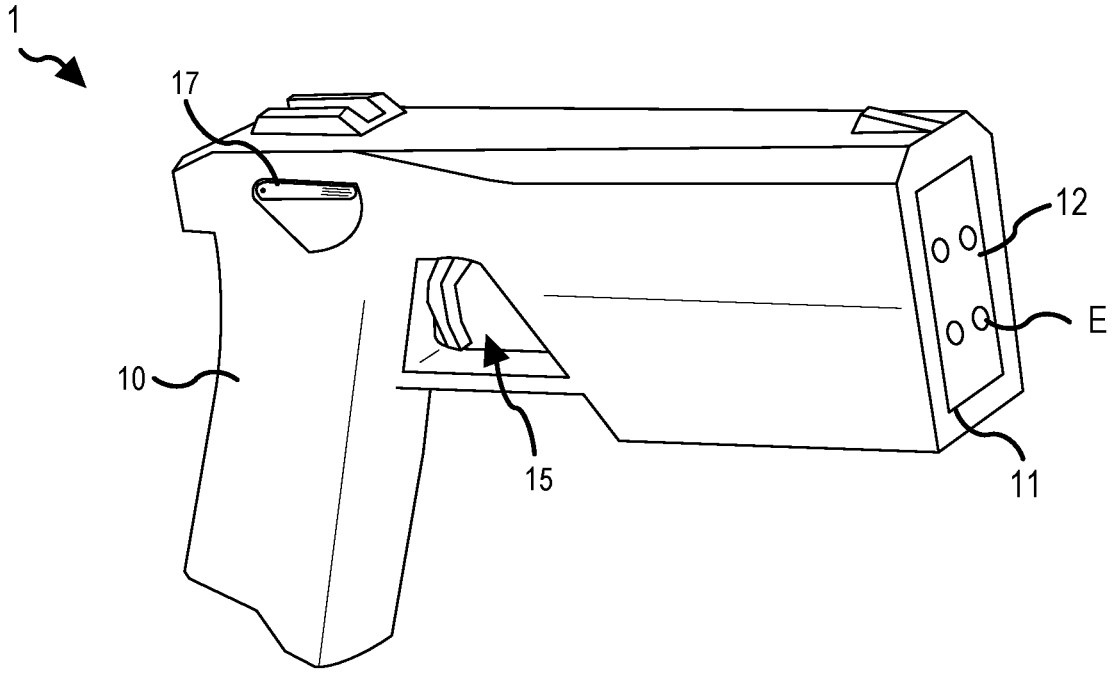
FIG. 1 is a perspective view of a conducted electrical weapon ("CEW"), in accordance with various embodiments.

Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

DETAILED DESCRIPTION

The detailed description of exemplary embodiments herein makes reference to the accompanying drawings, which show exemplary embodiments by way of illustration. While these embodiments are described in sufficient detail to enable those skilled in the art to practice the disclosures, it should be understood that other embodiments may be realized and that logical changes and adaptations in design and construction may be made in accordance with this disclosure and the teachings herein. Thus, the detailed description herein is presented for purposes of illustration only and not of limitation.

The scope of the disclosure is defined by the appended claims and their legal equivalents rather than by merely the examples described. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, coupled, connected, or the like may include permanent, removable, temporary, partial, full, and/or any other possible attachment option. Surface shading lines may be used throughout the figures to denote different parts but not necessarily to denote the same or different materials.

Systems, methods, and apparatuses may be used to interfere with voluntary locomotion (e.g., walking, running, moving, etc.) of a target. For example, a CEW may be used to deliver a current (e.g., stimulus signal, pulses of current, pulses of charge, etc.) through tissue of a human or animal target. Although typically referred to as a conducted electrical weapon, as described herein a "CEW" may refer to a conducted electrical weapon, a conducted energy weapon, an electronic control device, and/or any other similar device or apparatus configured to provide a stimulus signal through one or more deployed projectiles (e.g., electrodes).

A stimulus signal carries a charge into target tissue. The stimulus signal may interfere with voluntary locomotion of the target. The stimulus signal may cause pain. The pain may also function to encourage the target to stop moving. The stimulus signal may cause skeletal muscles of the target to become stiff (e.g., lock up, freeze, etc.). The stiffening of the muscles in response to a stimulus signal may be referred to as neuromuscular incapacitation ("NMI"). NMI disrupts voluntary control of the muscles of the target. The inability of the target to control its muscles interferes with locomotion of the target.

A stimulus signal may be delivered through the target via terminals coupled to the CEW. Delivery via terminals may be referred to as a local delivery (e.g., a local stun, a drive stun, etc.). During local delivery, the terminals are brought close to the target by positioning the CEW proximate to the target. The stimulus signal is delivered through the target's tissue via the terminals. To provide local delivery, the user of the CEW is generally within arm's reach of the target and brings the terminals of the CEW into contact with or proximate to the target.

A stimulus signal may be delivered through the target via one or more (typically at least two) wire-tethered electrodes. Delivery via wire-tethered electrodes may be referred to as a remote delivery (e.g., a remote stun). During a remote delivery, the CEW may be separated from the target up to the length (e.g., 15 feet, 20 feet, 30 feet, etc.) of the wire tether. The CEW launches the electrodes towards the target. As the electrodes travel toward the target, the respective wire tethers deploy behind the electrodes. The wire tether electrically couples the CEW to the electrode. The electrode may electrically couple to the target thereby coupling the CEW to the target. In response to the electrodes connecting with, impacting on, or being positioned proximate to the target's tissue, the current may be provided through the target via the electrodes (e.g., a circuit is formed through the first tether and the first electrode, the target's tissue, and the second electrode and the second tether).

Terminals or electrodes that contact or are proximate to the target's tissue deliver the stimulus signal through the target. Contact of a terminal or electrode with the target's tissue establishes an electrical coupling (e.g., circuit) with the target's tissue. Electrodes may include a spear that may pierce the target's tissue to contact the target. A terminal or electrode that is proximate to the target's tissue may use ionization to establish an electrical coupling with the target's tissue. Ionization may also be referred to as arcing.

In use (e.g., during deployment), a terminal or electrode may be separated from the target's tissue by the target's clothing or a gap of air. In various embodiments, a signal generator of the CEW may provide the stimulus signal (e.g., current, pulses of current, etc.) at a high voltage (e.g., in the range of 40,000 to 100,000 volts) to ionize the air in the clothing or the air in the gap that separates the terminal or electrode from the target's tissue. Ionizing the air establishes a low impedance ionization path from the terminal or electrode to the target's tissue that may be used to deliver the stimulus signal into the target's tissue via the ionization path. The ionization path persists (e.g., remains in existence, lasts, etc.) as long as the current of a pulse of the stimulus signal is provided via the ionization path. When the current ceases or is reduced below a threshold (e.g., amperage, voltage), the ionization path collapses (e.g., ceases to exist) and the terminal or electrode is no longer electrically coupled to the target's tissue. Lacking the ionization path, the impedance between the terminal or electrode and target tissue is high. A high voltage in the range of about 50,000 volts can ionize air in a gap of up to about one inch.

A CEW may provide a stimulus signal as a series of current pulses. Each current pulse may include a high voltage portion (e.g., 40,000-100,000 volts) and a low voltage portion (e.g., 500-6,000 volts). The high voltage portion of a pulse of a stimulus signal may ionize air in a gap between an electrode or terminal and a target to electrically couple the electrode or terminal to the target. In response to the electrode or terminal being electrically coupled to the target, the low voltage portion of the pulse delivers an amount of charge into the target's tissue via the ionization path. In response to the electrode or terminal being electrically coupled to the target by contact (e.g., touching, spear embedded into tissue, etc.), the high portion of the pulse and the low portion of the pulse both deliver charge to the target's tissue. Generally, the low voltage portion of the pulse delivers a majority of the charge of the pulse into the target's tissue. In various embodiments, the high voltage portion of a pulse of the stimulus signal may be referred to as the spark or ionization portion. The low voltage portion of a pulse may be referred to as the muscle portion.

In various embodiments, a signal generator of the CEW may provide the stimulus signal (e.g., current, pulses of current, etc.) at only a low voltage (e.g., less than 2,000 volts). The low voltage stimulus signal may not ionize the air in the clothing or the air in the gap that separates the terminal or electrode from the target's tissue. A CEW having a signal generator providing stimulus signals at only a low voltage (e.g., a low voltage signal generator) may require deployed electrodes to be electrically coupled to the target by contact (e.g., touching, spear embedded into tissue, etc.).

A CEW may include at least two terminals at the face of the CEW. A CEW may include two terminals for each bay that accepts a magazine (e.g., deployment unit). The terminals are spaced apart from each other. In response to the electrodes of the magazine in the bay having not been deployed, the high voltage impressed across the terminals will result in ionization of the air between the terminals. The arc between the terminals may be visible to the naked eye. In response to a launched electrode not electrically coupling to a target, the current that would have been provided via the electrodes may arc across the face of the CEW via the terminals.

The likelihood that the stimulus signal will cause NMI increases when the electrodes that deliver the stimulus signal are spaced apart at least 6 inches (15.24 centimeters) so that the current from the stimulus signal flows through the at least 6 inches of the target's tissue. In various embodiments, the electrodes preferably should be spaced apart at least 12 inches (30.48 centimeters) on the target. Because the terminals on a CEW are typically less than 6 inches apart, a stimulus signal delivered through the target's tissue via terminals likely will not cause NMI, only pain.

A series of pulses may include two or more pulses separated in time. Each pulse delivers an amount of charge into the target's tissue. In response to the electrodes being appropriately spaced (as discussed above), the likelihood of inducing NMI increases as each pulse delivers an amount of charge in the range of 55 microcoulombs to 71 microcoulombs per pulse. The likelihood of inducing NMI increases when the rate of pulse delivery (e.g., rate, pulse rate, repetition rate, etc.) is between 11 pulses per second ("pps") and 50 pps. Pulses delivered at a higher rate may provide less charge per pulse to induce NMI. Pulses that deliver more charge per pulse may be delivered at a lesser rate to induce NMI. In various embodiments, a CEW may be hand-held and use batteries to provide the pulses of the stimulus signal. In response to the amount of charge per pulse being high and the pulse rate being high, the CEW may use more energy than is needed to induce NMI. Using more energy than is needed depletes batteries more quickly.

Empirical testing has shown that the power of the battery may be conserved with a high likelihood of causing NMI in response to the pulse rate being less than 44 pps and the charge per a pulse being about 63 microcoulombs. Empirical testing has shown that a pulse rate of 22 pps and 63 microcoulombs per a pulse via a pair of electrodes will induce NMI when the electrode spacing is at least 12 inches (30.48 centimeters).

In various embodiments, a CEW may include a handle and one or more magazines (e.g., deployment units, etc.). The handle may include one or more bays for receiving the magazine(s). Each magazine may be removably positioned in (e.g., inserted into, coupled to, etc.) a bay. Each magazine may releasably electrically, electronically, and/or mechanically couple to a bay. A deployment of the CEW may launch one or more electrodes from the magazine and toward a target to remotely deliver the stimulus signal through the target.

In various embodiments, a magazine may include two or more electrodes (e.g., projectiles, cartridges, etc.) that are launched at the same time. In various embodiments, a magazine may include two or more electrodes that may each be launched individually at separate times. In various embodiments, a magazine may include a single electrode configured to be launched from the magazine. Launching the electrodes may be referred to as activating (e.g., firing) a magazine or electrode. After use (e.g., activation, firing), a magazine may be removed from the bay and replaced with an unused (e.g., not fired, not activated) magazine to permit launch of additional electrodes.

Figure 2:
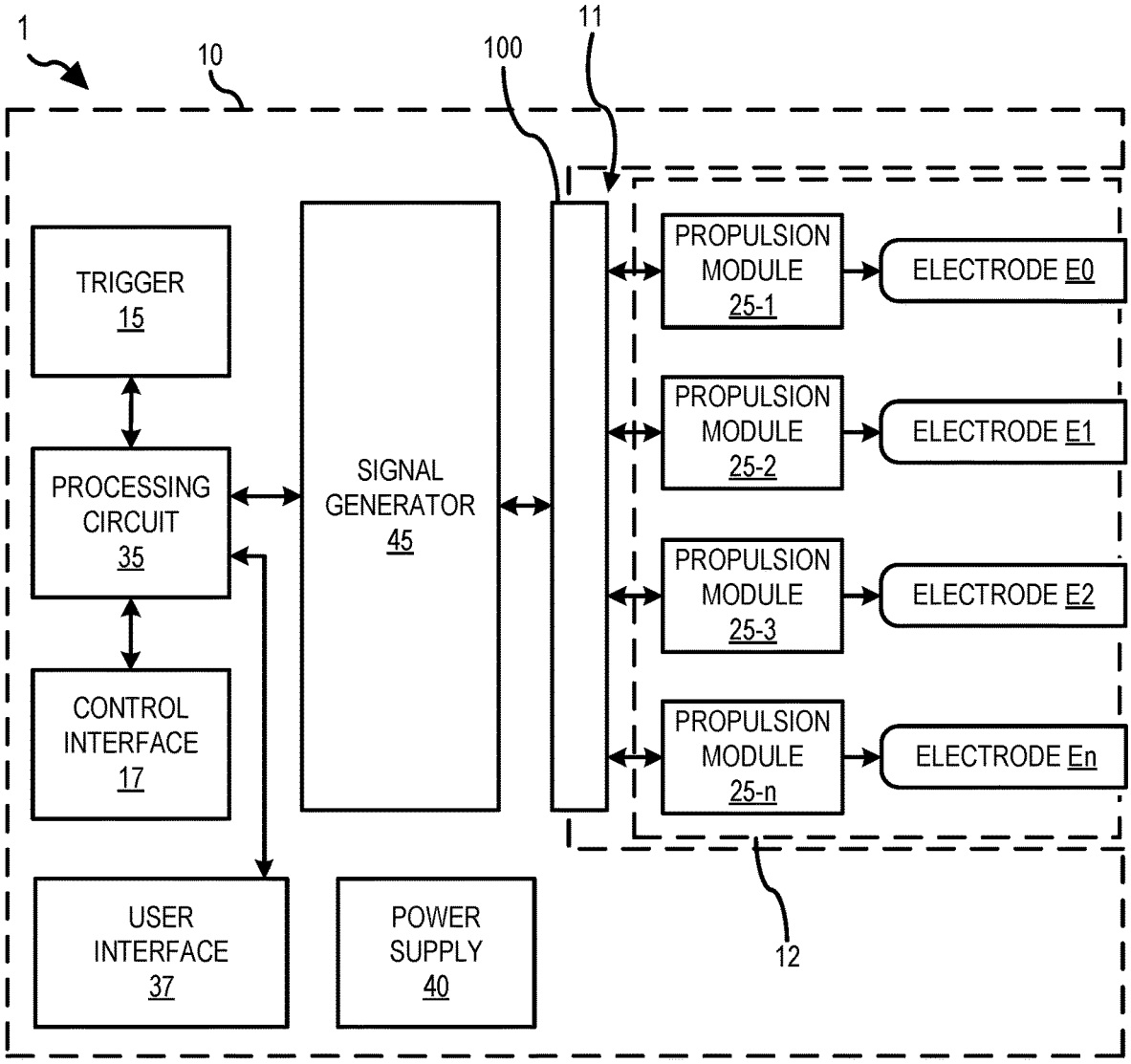
FIG. 2 is a schematic view of a CEW, in accordance with various embodiments.

In various embodiments, and with reference to FIGS. 1 and 2, a CEW 1 is disclosed. CEW 1 may be similar to, or have similar aspects and/or components with, any CEW discussed herein. CEW 1 may comprise a housing 10 and a magazine 12. It should be understood by one skilled in the art that FIG. 2 is a schematic representation of CEW 1, and one or more of the components of CEW 1 may be located in any suitable position within, or external to, housing 10.

Housing 10 may be configured to house various components of CEW 1 that are configured to enable deployment of magazine 12, provide an electrical current to magazine 12, and otherwise aid in the operation of CEW 1, as discussed further herein. Although depicted as a firearm in FIG. 1, housing 10 may comprise any suitable shape and/or size. Housing 10 may comprise a handle end opposite a deployment end. A deployment end may be configured, and sized and shaped, to receive one or more magazine 12. A handle end may be sized and shaped to be held in a hand of a user. For example, a handle end may be shaped as a handle to enable hand-operation of CEW 1 by the user. In various embodiments, a handle end may also comprise contours shaped to fit the hand of a user, for example, an ergonomic grip. A handle end may include a surface coating, such as, for example, a non-slip surface, a grip pad, a rubber texture, and/or the like. As a further example, a handle end may be wrapped in leather, a colored print, and/or any other suitable material, as desired.

In various embodiments, housing 10 may comprise various mechanical, electronic, and/or electrical components configured to aid in performing the functions of CEW 1. For example, housing 10 may comprise one or more triggers 15, control interfaces 17, processing circuits 35, power supplies 40, and/or signal generators 45. Housing 10 may include a guard (e.g., trigger guard). A guard may define an opening formed in housing 10. A guard may be located on a center region of housing 10 (e.g., as depicted in FIG. 1), and/or in any other suitable location on housing 10. Trigger 15 may be disposed within a guard. A guard may be configured to protect trigger 15 from unintentional physical contact (e.g., an unintentional activation of trigger 15). A guard may surround trigger 15 within housing 10.

In various embodiments, trigger 15 may be coupled to an outer surface of housing 10, and may be configured to move, slide, rotate, or otherwise become physically depressed or moved upon application of physical contact. For example, trigger 15 may be actuated by physical contact applied to trigger 15 from within a guard. Trigger 15 may comprise a mechanical or electromechanical switch, button, trigger, or the like. For example, trigger 15 may comprise a switch, a pushbutton, and/or any other suitable type of trigger. Trigger 15 may be mechanically and/or electronically coupled to processing circuit 35. In response to trigger 15 being activated (e.g., depressed, pushed, etc. by the user), processing circuit 35 may enable deployment of (or cause deployment of) one or more magazine 12 from CEW 1, as discussed further herein.

In various embodiments, power supply 40 may be configured to provide power to various components of CEW 1. For example, power supply 40 may provide energy for operating the electronic and/or electrical components (e.g., parts, subsystems, circuits, etc.) of CEW 1 and/or one or more magazine 12. Power supply 40 may provide electrical power. Providing electrical power may include providing a current at a voltage. Power supply 40 may be electrically coupled to processing circuit 35 and/or signal generator 45. In various embodiments, in response to a control interface comprising electronic properties and/or components, power supply 40 may be electrically coupled to the control interface. In various embodiments, in response to trigger 15 comprising electronic properties or components, power supply 40 may be electrically coupled to trigger 15. Power supply 40 may provide an electrical current at a voltage. Electrical power from power supply 40 may be provided as a direct current ("DC"). Electrical power from power supply 40 may be provided as an alternating current ("AC"). Power supply 40 may include a battery. The energy of power supply 40 may be renewable or exhaustible, and/or replaceable. For example, power supply 40 may comprise one or more rechargeable or disposable batteries. In various embodiments, the energy from power supply 40 may be converted from one form (e.g., electrical, magnetic, thermal) to another form to perform the functions of a system.

Power supply 40 may provide energy for performing the functions of CEW 1. For example, power supply 40 may provide the electrical current to signal generator 45 that is provided through a target to impede locomotion of the target (e.g., via magazine 12). Power supply 40 may provide the energy for a stimulus signal. Power supply 40 may provide the energy for other signals, including an ignition signal, as discussed further herein.

In various embodiments, processing circuit 35 may comprise any circuitry, electrical components, electronic components, software, and/or the like configured to perform various operations and functions discussed herein. For example, processing circuit 35 may comprise a processing circuit, a processor, a digital signal processor, a microcontroller, a microprocessor, an application specific integrated circuit (ASIC), a programmable logic device, logic circuitry, state machines, MEMS devices, signal conditioning circuitry, communication circuitry, a computer, a computer-based system, a radio, a network appliance, a data bus, an address bus, and/or any combination thereof. In various embodiments, processing circuit 35 may include passive electronic devices (e.g., resistors, capacitors, inductors, etc.) and/or active electronic devices (e.g., op amps, comparators, analog-to-digital converters, digital-to-analog converters, programmable logic, SRCs, transistors, etc.). In various embodiments, processing circuit 35 may include data buses, output ports, input ports, timers, memory, arithmetic units, and/or the like.

In various embodiments, processing circuit 35 may include signal conditioning circuity. Signal conditioning circuitry may include level shifters to change (e.g., increase, decrease) the magnitude of a voltage (e.g., of a signal) before receipt by processing circuit 35 or to shift the magnitude of a voltage provided by processing circuit 35.

In various embodiments, processing circuit 35 may be configured to control and/or coordinate operation of some or all aspects of CEW 1. For example, processing circuit 35 may include (or be in communication with) memory configured to store data, programs, and/or instructions. The memory may comprise a tangible non-transitory computer-readable memory. Instructions stored on the tangible non-transitory memory may allow processing circuit 35 to perform various operations, functions, and/or steps, as described herein.

In various embodiments, the memory may comprise any hardware, software, and/or database component capable of storing and maintaining data. For example, a memory unit may comprise a database, data structure, memory component, or the like. A memory unit may comprise any suitable non-transitory memory known in the art, such as, an internal memory (e.g., random access memory (RAM), read-only memory (ROM), solid state drive (SSD), etc.), removable memory (e.g., an SD card, an xD card, a CompactFlash card, etc.), or the like.

Processing circuit 35 may be configured to provide and/or receive electrical signals whether digital and/or analog in form. Processing circuit 35 may provide and/or receive digital information via a data bus using any protocol. Processing circuit 35 may receive information, manipulate the received information, and provide the manipulated information. Processing circuit 35 may store information and retrieve stored information. Information received, stored, and/or manipulated by processing circuit 35 may be used to perform a function, control a function, and/or to perform an operation or execute a stored program.

Processing circuit 35 may control the operation and/or function of other circuits and/or components of CEW 1. Processing circuit 35 may receive status information regarding the operation of other components, perform calculations with respect to the status information, and provide commands (e.g., instructions) to one or more other components. Processing circuit 35 may command another component to start operation, continue operation, alter operation, suspend operation, cease operation, or the like. Commands and/or status may be communicated between processing circuit 35 and other circuits and/or components via any type of bus (e.g., SPI bus) including any type of data/address bus.

In various embodiments, processing circuit 35 may be mechanically and/or electronically coupled to trigger 15. Processing circuit 35 may be configured to detect an activation, actuation, depression, input, etc. (collectively, an "activation event") of trigger 15. In response to detecting the activation event, processing circuit 35 may be configured to perform various operations and/or functions, as discussed further herein. Processing circuit 35 may also include a sensor (e.g., a trigger sensor) attached to trigger 15 and configured to detect an activation event of trigger 15. The sensor may comprise any suitable sensor, such as a mechanical and/or electronic sensor capable of detecting an activation event in trigger 15 and reporting the activation event to processing circuit 35.

In various embodiments, processing circuit 35 may be mechanically and/or electronically coupled to control interface 17. Processing circuit 35 may be configured to detect an activation, actuation, depression, input, etc. (collectively, a "control event") of control interface 17. In response to detecting the control event, processing circuit 35 may be configured to perform various operations and/or functions, as discussed further herein. Processing circuit 35 may also include a sensor (e.g., a control sensor) attached to control interface 17 and configured to detect a control event of control interface 17. The sensor may comprise any suitable mechanical and/or electronic sensor capable of detecting a control event in control interface 17 and reporting the control event to processing circuit 35.

In various embodiments, processing circuit 35 may be electrically and/or electronically coupled to power supply 40. Processing circuit 35 may receive power from power supply 40. The power received from power supply 40 may be used by processing circuit 35 to receive signals, process signals, and transmit signals to various other components in CEW 1. Processing circuit 35 may use power from power supply 40 to detect an activation event of trigger 15, a control event of control interface 17, or the like, and generate one or more control signals in response to the detected events. The control signal may be based on the control event and the activation event. The control signal may be an electrical signal.

In various embodiments, processing circuit 35 may be electrically and/or electronically coupled to signal generator 45. Processing circuit 35 may be configured to transmit or provide control signals to signal generator 45 in response to detecting an activation event of trigger 15. Multiple control signals may be provided from processing circuit 35 to signal generator 45 in series. In response to receiving the control signal, signal generator 45 may be configured to perform various functions and/or operations, as discussed further herein.

In various embodiments, signal generator 45 may be configured to receive one or more control signals from processing circuit 35. Signal generator 45 may provide an ignition signal to magazine 12 based on the control signals. Signal generator 45 may be electrically and/or electronically coupled to processing circuit 35 and/or magazine 12. Signal generator 45 may be electrically coupled to power supply 40. Signal generator 45 may use power received from power supply 40 to generate an ignition signal. For example, signal generator 45 may receive an electrical signal from power supply 40 that has first current and voltage values. Signal generator 45 may transform the electrical signal into an ignition signal having second current and voltage values. The transformed second current and/or the transformed second voltage values may be different from the first current and/or voltage values. The transformed second current and/or the transformed second voltage values may be the same as the first current and/or voltage values. Signal generator 45 may temporarily store power from power supply 40 and rely on the stored power entirely or in part to provide the ignition signal. Signal generator 45 may also rely on received power from power supply 40 entirely or in part to provide the ignition signal, without needing to temporarily store power.

Signal generator 45 may be controlled entirely or in part by processing circuit 35. In various embodiments, signal generator 45 and processing circuit 35 may be separate components (e.g., physically distinct and/or logically discrete). Signal generator 45 and processing circuit 35 may be a single component. For example, a control circuit within housing 10 may at least include signal generator 45 and processing circuit 35. The control circuit may also include other components and/or arrangements, including those that further integrate corresponding function of these elements into a single component or circuit, as well as those that further separate certain functions into separate components or circuits.

Signal generator 45 may be controlled by the control signals to generate an ignition signal having a predetermined current value or values. For example, signal generator 45 may include a current source. The control signal may be received by signal generator 45 to activate the current source at a current value of the current source. An additional control signal may be received to decrease a current of the current source. For example, signal generator 45 may include a pulse width modification circuit coupled between a current source and an output of the control circuit. A second control signal may be received by signal generator 45 to activate the pulse width modification circuit, thereby decreasing a non-zero period of a signal generated by the current source and an overall current of an ignition signal subsequently output by the control circuit. The pulse width modification circuit may be separate from a circuit of the current source or, alternatively, integrated within a circuit of the current source. Various other forms of signal generators 45 may alternatively or additionally be employed, including those that apply a voltage over one or more different resistances to generate signals with different currents. In various embodiments, signal generator 45 may include a high-voltage module configured to deliver an electrical current having a high voltage. In various embodiments, signal generator 45 may include a low-voltage module configured to deliver an electrical current having a lower voltage, such as, for example, 2,000 volts.

Responsive to receipt of a signal indicating activation of trigger 15 (e.g., an activation event), a control circuit provides an ignition signal to magazine 12 (or an electrode in magazine 12). For example, signal generator 45 may provide an electrical signal as an ignition signal to magazine 12 in response to receiving a control signal from processing circuit 35. In various embodiments, the ignition signal may be separate and distinct from a stimulus signal. For example, a stimulus signal in CEW 1 may be provided to a different circuit within magazine 12, relative to a circuit to which an ignition signal is provided. Signal generator 45 may be configured to generate a stimulus signal. In various embodiments, a second, separate signal generator, component, or circuit (not shown) within housing 10 may be configured to generate the stimulus signal. Signal generator 45 may also provide a ground signal path for magazine 12, thereby completing a circuit for an electrical signal provided to magazine 12 by signal generator 45. The ground signal path may also be provided to magazine 12 by other elements in housing 10, including power supply 40.

In various embodiments, a bay 11 of housing 10 may be configured (to receive one or more magazine 12. Bay 11 may comprise an opening in an end of housing 10 sized and shaped to receive one or more magazine 12. Bay 11 may include one or more mechanical features configured to removably couple one or more magazine 12 within bay 11. Bay 11 of housing 10 may be configured to receive a single magazine, two magazines, three magazines, nine magazines, or any other number of magazines.

In various embodiments, a CEW 1 may include an interposer 100. Interposer 100 may be configured to at least partially couple to an end of a magazine 12. Interposer 100 may be configured to at least partially seal the end of the magazine 12. Interposer 100 may be configured to at least partially retain or couple to one or more cartridges or projectiles loaded into a magazine 12. Interposer 100 may be configured to at least partially prevent electrical shorting between two or more cartridges or projectiles loaded into a same magazine 12. Interposer 100 may be configured to provide electrical coupling between signal generator 45 and the one or more cartridges or projectiles in a magazine 12. In that regard, interposer 100 may provide an electrical signal to one or more cartridges or projectiles, from signal generator 45, to cause deployment of the one or more cartridges or projectiles from the magazine 12.

Further, interposer 100 may provide a stimulus signal to a deployed cartridge or projectile from signal generator 45. Interposer 100 may be configured to at least partially reduce a recoil force imparted into housing 10 in response to deployment of a cartridge or projectile from a magazine 12 loaded into bay 11 of housing 10. For example, interposer 100 may be configured to distribute an impact load across a greater surface area (e.g., surface of interposer 100). As a further example, interposer 100 may comprise one or more surfaces or materials configured to receive and distribute an impact load from a cartridge or projectile deployment. In some embodiments, at least partially reducing the recoil force imparted from deployment of a cartridge or projectile may increase the lifespan of one or more components in a cartridge or projectile, magazine 12, and/or housing 10.

In some embodiments, interposer 100 may be positioned within bay 11 of housing 10. Interposer 100 may be positioned within housing 10 such that at least a portion of interposer 100 is accessible within bay 11. Interposer 100 may couple to a magazine 12 in response to the magazine 12 being inserted into bay 11. In response to the magazine 12 being removed from bay 11, interposer 100 may decouple from the magazine 12 and remain positioned in bay 11.

In some embodiments, interposer 100 may be coupled to an end of a magazine 12 before the magazine 12 is positioned within bay 11. For example, a user may load one or more cartridges into the magazine 12, couple interposer 100 to the magazine 12, and insert the magazine 12 into bay 11. In response to the magazine 12 being removed from bay 11, interposer 100 may remain coupled to the magazine 12.

Magazine 12 may comprise one or more propulsion modules 25 and one or more electrodes E. For example, a magazine 12 may comprise a single propulsion module 25 configured to deploy a single electrode E. As a further example, a magazine 12 may comprise a single propulsion module 25 configured to deploy a plurality of electrodes E. As a further example, a magazine 12 may comprise a plurality of propulsion modules 25 and a plurality of electrodes E, with each propulsion module 25 configured to deploy one or more electrodes E. In various embodiments, and as depicted in FIG. 2, magazine 12 may comprise a first propulsion module 25-1 configured to deploy a first electrode E0, a second propulsion module 25-2 configured to deploy a second electrode E1, a third propulsion module 25-3 configured to deploy a third electrode E2, and a fourth propulsion module 25-4 configured to deploy a fourth electrode E3. Each series of propulsion modules and electrodes may be contained in the same and/or separate magazines.

In various embodiments, a propulsion module 25 may be coupled to, or in communication with one or more electrodes E in magazine 12. In various embodiments, magazine 12 may comprise a plurality of propulsion modules 25, with each propulsion module 25 coupled to, or in communication with, one or more electrodes E. A propulsion module 25 may comprise any device, propellant (e.g., air, gas, etc.), primer, or the like capable of providing a propulsion force in magazine 12. The propulsion force may include an increase in pressure caused by rapidly expanding gas within an area or chamber. The propulsion force may be applied to one or more electrodes E in magazine 12 to cause the deployment of the one or more electrodes E. A propulsion module 25 may provide the propulsion force in response to magazine 12 receiving an ignition signal, as previously discussed.

In various embodiments, the propulsion force may be directly applied to one or more electrodes E. For example, a propulsion force from propulsion module 25-1 may be provided directly to first electrode E0. A propulsion module 25 may be in fluid communication with one or more electrodes E to provide the propulsion force. For example, a propulsion force from propulsion module 25-1 may travel within a housing or channel of magazine 12 to first electrode E0. The propulsion force may travel via a manifold in magazine 12.

In various embodiments, the propulsion force may be provided indirectly to one or more electrodes E. For example, the propulsion force may be provided to a secondary source of propellant within propulsion system 125. The propulsion force may launch the secondary source of propellant within propulsion system 125, causing the secondary source of propellant to release propellant. A force associated with the released propellant may in turn provide a force to one or more electrodes E. A force generated by a secondary source of propellant may cause the one or more electrodes E to be deployed from the magazine 12 and CEW 1.

In various embodiments, each electrode E0, E1, E2, E3 may each comprise any suitable type of projectile. For example, one or more electrodes E may be or include a projectile, an electrode (e.g., an electrode dart), an entangling projectile, a payload projectile (e.g., comprising a liquid or gas substance), or the like. An electrode may include a spear portion, designed to pierce or attach proximate a tissue of a target in order to provide a conductive electrical path between the electrode and the tissue, as previously discussed herein.

Control interface 17 of CEW 1 may comprise, or be similar to, any control interface disclosed herein. In various embodiments, control interface 17 may be configured to control selection of firing modes in CEW 1. Controlling selection of firing modes in CEW 1 may include disabling firing of CEW 1 (e.g., a safety mode, etc.), enabling firing of CEW 1 (e.g., an active mode, a firing mode, an escalation mode, etc.), controlling deployment of magazine 12, and/or similar operations, as discussed further herein. In various embodiments, control interface 17 may also be configured to perform (or cause performance of) one or more operations that do not include the selection of firing modes. For example, control interface 17 may be configured to enable the selection of operating modes of CEW 1, selection of options within an operating mode of CEW 1, or similar selection or scrolling operations, as discussed further herein.

Control interface 17 may be located in any suitable location on or in housing 10. For example, control interface 17 may be coupled to an outer surface of housing 10. Control interface 17 may be coupled to an outer surface of housing 10 proximate trigger 15 and/or a guard of housing 10. Control interface 17 may be electrically, mechanically, and/or electronically coupled to processing circuit 35. In various embodiments, in response to control interface 17 comprising electronic properties or components, control interface 17 may be electrically coupled to power supply 40. Control interface 17 may receive power (e.g., electrical current) from power supply 40 to power the electronic properties or components.

Control interface 17 may be electronically or mechanically coupled to trigger 15. For example, and as discussed further herein, control interface 17 may function as a safety mechanism. In response to control interface 17 being set to a "safety mode," CEW 1 may be unable to launch electrodes from magazine 12. For example, control interface 17 may provide a signal (e.g., a control signal) to processing circuit 35 instructing processing circuit 35 to disable deployment of electrodes from magazine 12. As a further example, control interface 17 may electronically or mechanically prohibit trigger 15 from activating (e.g., prevent or disable a user from depressing trigger 15; prevent trigger 15 from launching an electrode; etc.).

Control interface 17 may comprise any suitable electronic or mechanical component capable of enabling selection of firing modes. For example, control interface 17 may comprise a fire mode selector switch, a safety switch, a safety catch, a rotating switch, a selection switch, a selective firing mechanism, and/or any other suitable mechanical control. As a further example, control interface 17 may comprise a slide, such as a handgun slide, a reciprocating slide, or the like. As a further example, control interface 17 may comprise a touch screen, user interface or display, or similar electronic visual component.

The safety mode may be configured to prohibit deployment of an electrode from magazine 12 in CEW 1. For example, in response to a user selecting the safety mode, control interface 17 may transmit a safety mode instruction to processing circuit 35. In response to receiving the safety mode instruction, processing circuit 35 may prohibit deployment of an electrode from magazine 12. Processing circuit 35 may prohibit deployment until a further instruction is received from control interface 17 (e.g., a firing mode instruction). As previously discussed, control interface 17 may also, or alternatively, interact with trigger 15 to prevent activation of trigger 15. In various embodiments, the safety mode may also be configured to prohibit deployment of a stimulus signal from signal generator 45, such as, for example, a local delivery.

The firing mode may be configured to enable deployment of one or more electrodes from magazine 12 in CEW 1. For example, and in accordance with various embodiments, in response to a user selecting the firing mode, control interface 17 may transmit a firing mode instruction to processing circuit 35. In response to receiving the firing mode instruction, processing circuit 35 may enable deployment of an electrode from magazine 12. In that regard, in response to trigger 15 being activated, processing circuit 35 may cause the deployment of one or more electrodes. Processing circuit 35 may enable deployment until a further instruction is received from control interface 17 (e.g., a safety mode instruction). As a further example, and in accordance with various embodiments, in response to a user selecting the firing mode, control interface 17 may also mechanically (or electronically) interact with trigger 15 of CEW 1 to enable activation of trigger 15.

In various embodiments, CEW 1 may deliver a stimulus signal via a circuit that includes signal generator 45 positioned in the handle of CEW 1. An interface (e.g., cartridge interface, magazine interface, etc.) on each magazine 12 inserted into housing 10 electrically couples to an interface (e.g., handle interface, housing interface, etc.) in handle housing 10. Signal generator 45 couples to each magazine 12, and thus to the electrodes E, via the handle interface and the magazine interface. A first filament couples to the interface of the magazine 12 and to a first electrode. A second filament couples to the interface of the magazine 12 and to a second electrode. The stimulus signal travels from signal generator 45, through the first filament and the first electrode, through target tissue, and through the second electrode and second filament back to signal generator 45.

In various embodiments, CEW 1 may further comprise one or more user interfaces 37. A user interface 37 may be configured to receive an input from a user of CEW 1 and/or transmit an output to the user of CEW 1. User interface 37 may be located in any suitable location on or in housing 10. For example, user interface 37 may be coupled to an outer surface of housing 10, or extend at least partially through the outer surface of housing 10. User interface 37 may be electrically, mechanically, and/or electronically coupled to processing circuit 35. In various embodiments, in response to user interface 37 comprising electronic or electrical properties or components, user interface 37 may be electrically coupled to power supply 40. User interface 37 may receive power (e.g., electrical current) from power supply 40 to power the electronic properties or components.

In various embodiments, user interface 37 may comprise one or more components configured to receive an input from a user. For example, user interface 37 may comprise one or more of an audio capturing module (e.g., microphone) configured to receive an audio input, a visual display (e.g., touchscreen, LCD, LED, etc.) configured to receive a manual input, a mechanical interface (e.g., button, switch, etc.) configured to receive a manual input, and/or the like. In various embodiments, user interface 37 may comprise one or more components configured to transmit or produce an output. For example, user interface 37 may comprise one or more of an audio output module (e.g., audio speaker) configured to output audio, a light-emitting component (e.g., flashlight, laser guide, etc.) configured to output light, a visual display (e.g., touchscreen, LCD, LED, etc.) configured to output a visual, and/or the like.

Figure 3A:
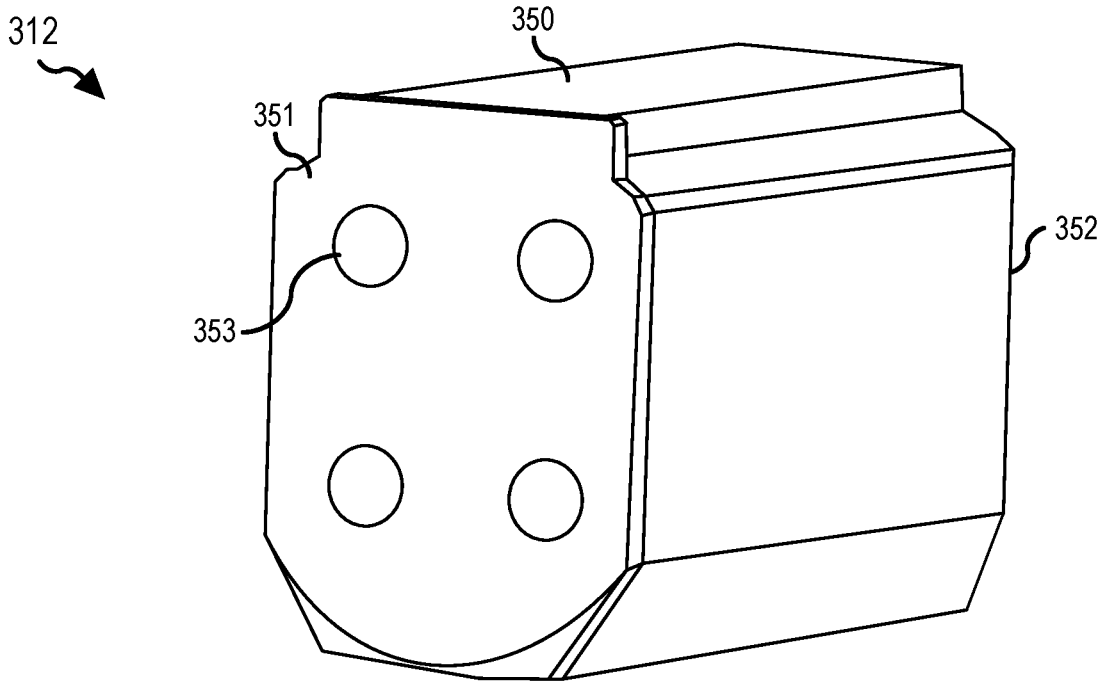
FIG. 3A is a front perspective view of a magazine for a CEW, in accordance with various embodiments.
Figure 3B:
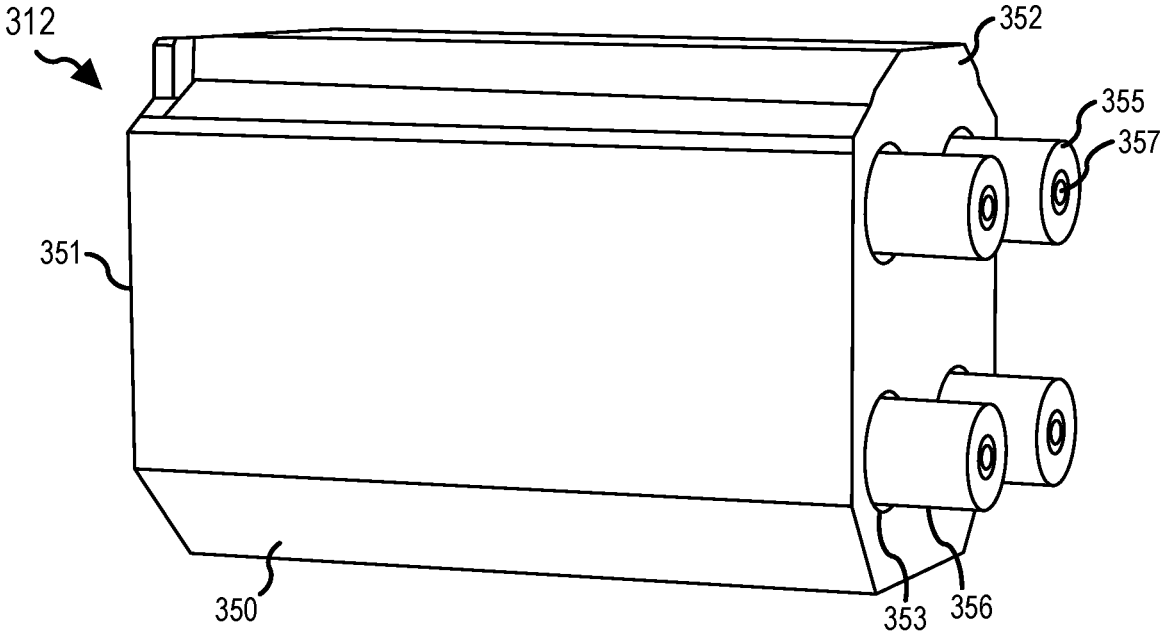
FIG. 3B is a rear perspective view of a magazine for a CEW, in accordance with various embodiments.

In various embodiments, and with reference to FIGS. 3A and 3B, a magazine 312 for a CEW is disclosed. Magazine 312 may be similar to any other magazine, deployment unit, or the like disclosed herein.

Magazine 312 may comprise a housing 350 sized and shaped to be inserted into the bay of a CEW handle, as previously discussed. Housing 350 may comprise a first end 351 (e.g., a deployment end, a front end, etc.) opposite a second end 352 (e.g., a loading end, a rear end, etc.). Magazine 312 may be configured to permit launch of one or more electrodes from first end 351 (e.g., electrodes are launched through first end 351). Magazine 312 may be configured to permit loading of one or more electrodes from second end 352. Second end 352 may also be configured to permit provision of electrical signals (e.g., stimulus signals, ignition signals, etc.) from the CEW to the one or more electrodes. In some embodiments, magazine 312 may also be configured to permit loading of one or more electrodes from first end 351.

In various embodiments, housing 350 may define one or more bores 353. A bore 353 may comprise an axial opening through housing 350, defined and open on first end 351 and/or second end 352. Each bore 353 may be configured to receive an electrode (or cartridge containing an electrode). Each bore 353 may be sized and shaped accordingly to receive and house an electrode (or cartridge containing an electrode) prior to and during deployment of the electrode from magazine 312. Each bore 353 may comprise any suitable deployment angle. One or more bores 353 may comprise similar deployment angles. One or more bores 353 may comprise different deployment angles. Housing 350 may comprise any suitable or desired number of bores 353, such as, for example, two bores, four bores (e.g., as depicted), five bores, nine bores, ten bores, and/or the like.

In various embodiments, magazine 312 may be configured to receive one or more cartridges 355. A cartridge 355 may comprise a body 356 housing an electrode and one or more components necessary to deploy the electrode from body 356. For example, cartridge 355 may comprise an electrode and a propulsion module. The electrode may be similar to any other electrode, projectile, or the like disclosed herein. The propulsion module may be similar to any other propulsion module, primer, or the like disclosed herein.

In various embodiments, cartridge 355 may comprise a cylindrical outer body 356 defining a hollow inner portion. The hollow inner portion may house an electrode (e.g., an electrode, a spear, a filament wire, etc.). The hollow inner portion may house a propulsion module configured to deploy the electrode from a first end of the cylindrical outer body 356. Cartridge 355 may include a piston positioned adjacent a second end of the electrode. Cartridge 355 may have the propulsion module positioned such that the piston is located between the electrode and the propulsion module. Cartridge 355 may also have a wad positioned adjacent the piston, where the wad is located between the propulsion module and the piston.

In various embodiments, a cartridge 355 may comprise a contact 357 on an end of body 356. Contact 357 may be configured to allow cartridge 355 to receive an electrical signal from a CEW handle. For example, contact 357 may comprise an electrical contact configured to enable the completion of an electrical circuit between cartridge 355 and a signal generator of the CEW handle. In that regard, contact 357 may be configured to transmit (or provide) a stimulus signal from the CEW handle to the electrode. As a further example, contact 357 may be configured to transmit (or provide) an electrical signal (e.g., an ignition signal) from the CEW handle to a propulsion module within the cartridge 355. For example, contact 357 may be configured to transmit (or provide) the electrical signal to a conductor of the propulsion module, thereby causing the conductor to heat up and ignite a pyrotechnic material inside the propulsion module. Ignition of the pyrotechnic material may cause the propulsion module to deploy (e.g., directly or indirectly) the electrode from the cartridge 355.

In operation, a cartridge 355 may be inserted into a bore 353 of a magazine 312. The magazine 312 may be inserted into the bay of a CEW handle, and/or coupled to an interposer of a CEW handle. The CEW may be operated to deploy an electrode from the cartridge 355 in magazine 312. Magazine 312 may be removed from the bay of the CEW handle. The cartridge 355 (e.g., a used cartridge, a spent cartridge, etc.) may be removed from the bore 353 of magazine 312. A new cartridge 355 may then be inserted into the same bore 353 of magazine 312 for additional deployments. The number of cartridges 355 that magazine 312 is capable of receiving may be dependent on a number of bores 353 in housing 350. For example, in response to housing 350 comprising four bores 353, magazine 312 may be configured to receive at most four cartridges 355 at the same time. As a further example, in response to housing 350 comprising ten bores 353, magazine 312 may be configured to receive at most ten cartridges 355 at the same time.

Figure 4A:
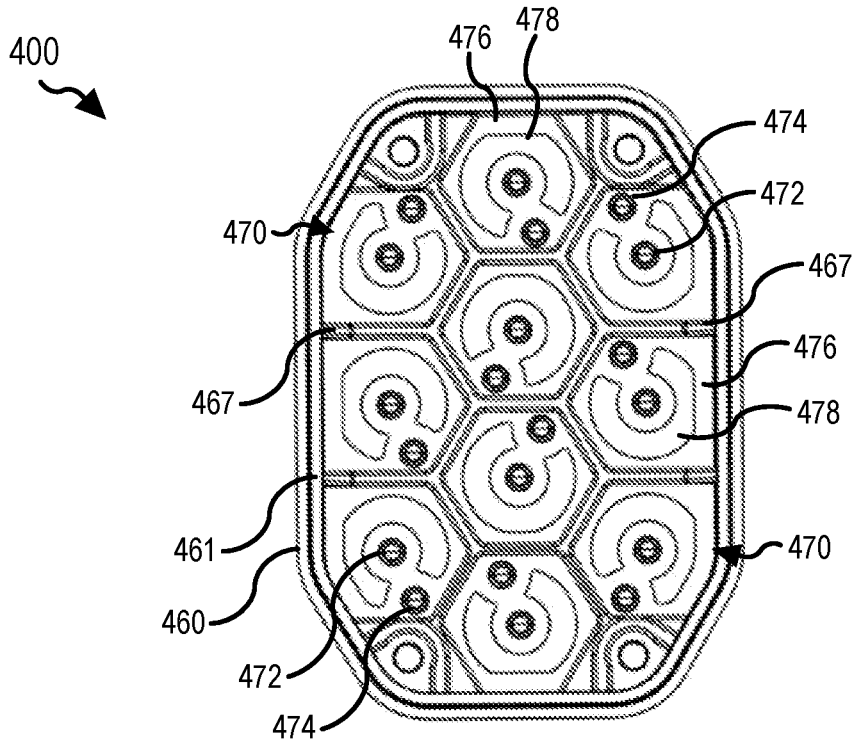
FIG. 4A is a front view of an interposer for a CEW, in accordance with various embodiments.
Figure 4B:
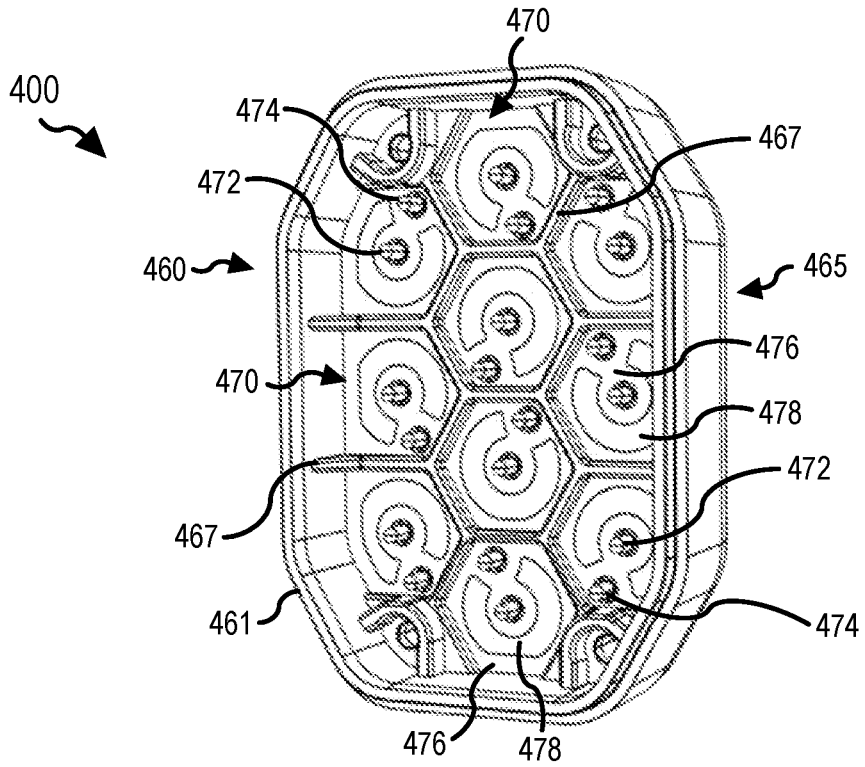
FIG. 4B is a perspective view of an interposer for a CEW, in accordance with various embodiments.
Figure 4C:
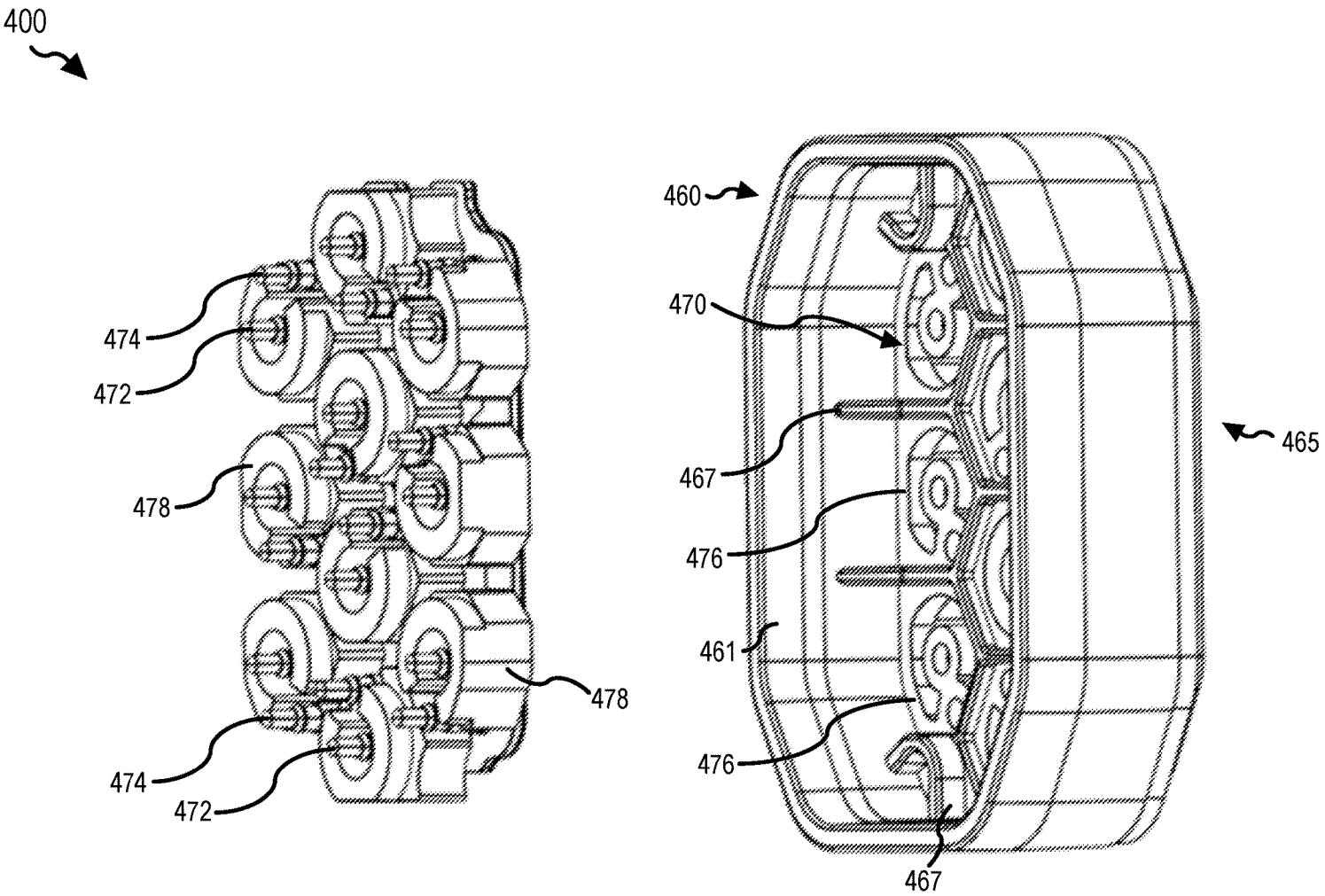
FIG. 4C is an exploded perspective view of an interposer for a CEW, in accordance with various embodiments.
Figure 5A:
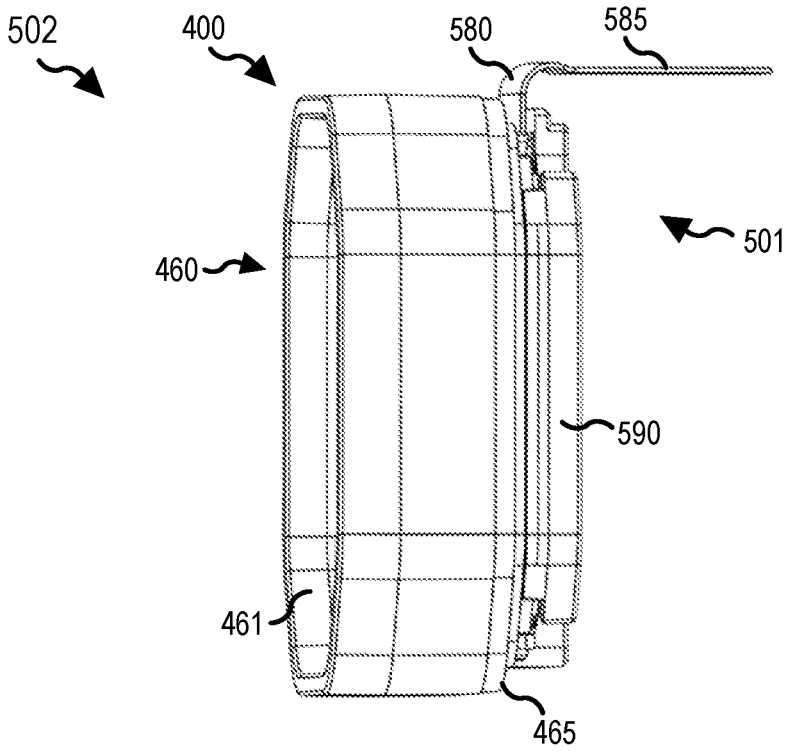
FIG. 5A is a side perspective view of an interposer assembly for a CEW, in accordance with various embodiments.
Figure 5B:
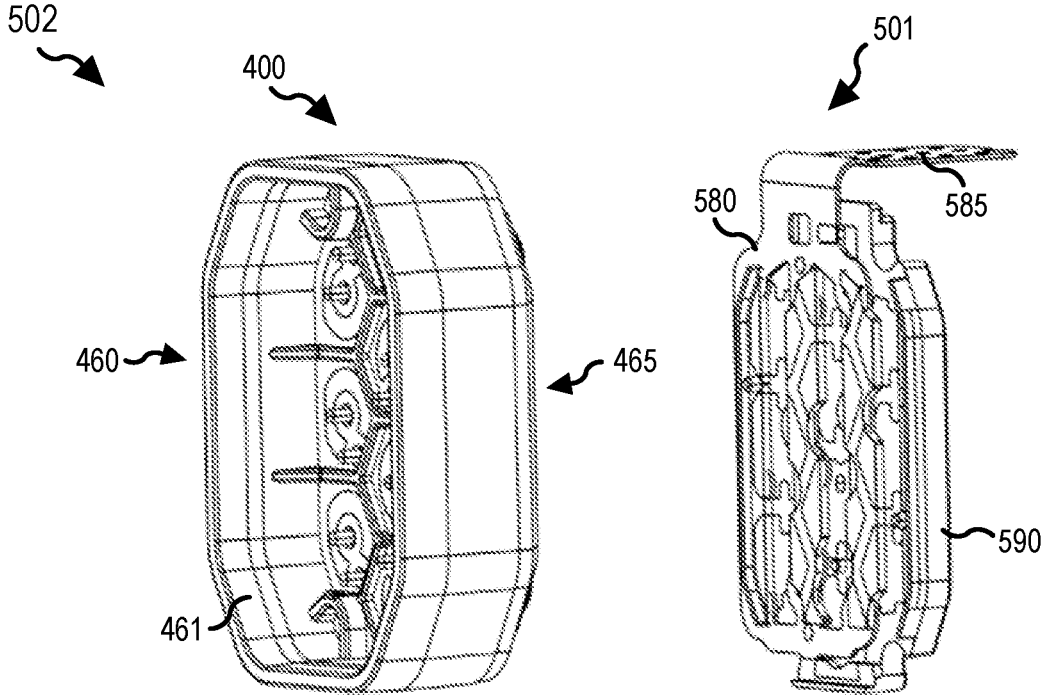
FIG. 5B is an exploded perspective view of an interposer assembly for a CEW, in accordance with various embodiments.
Figure 5C:
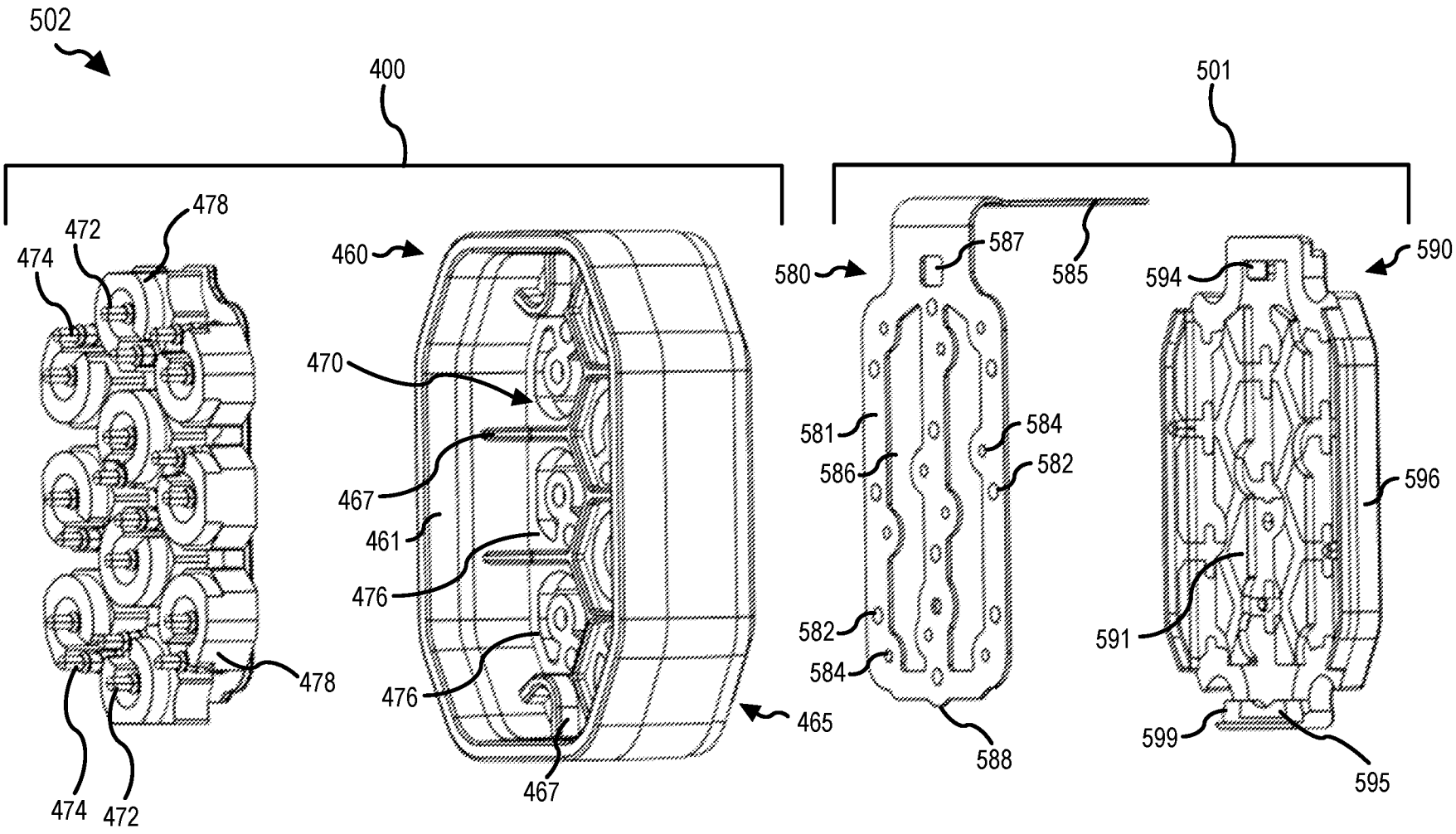
FIG. 5C is an exploded perspective view of an interposer assembly for a CEW, in accordance with various embodiments.
Figure 5D:
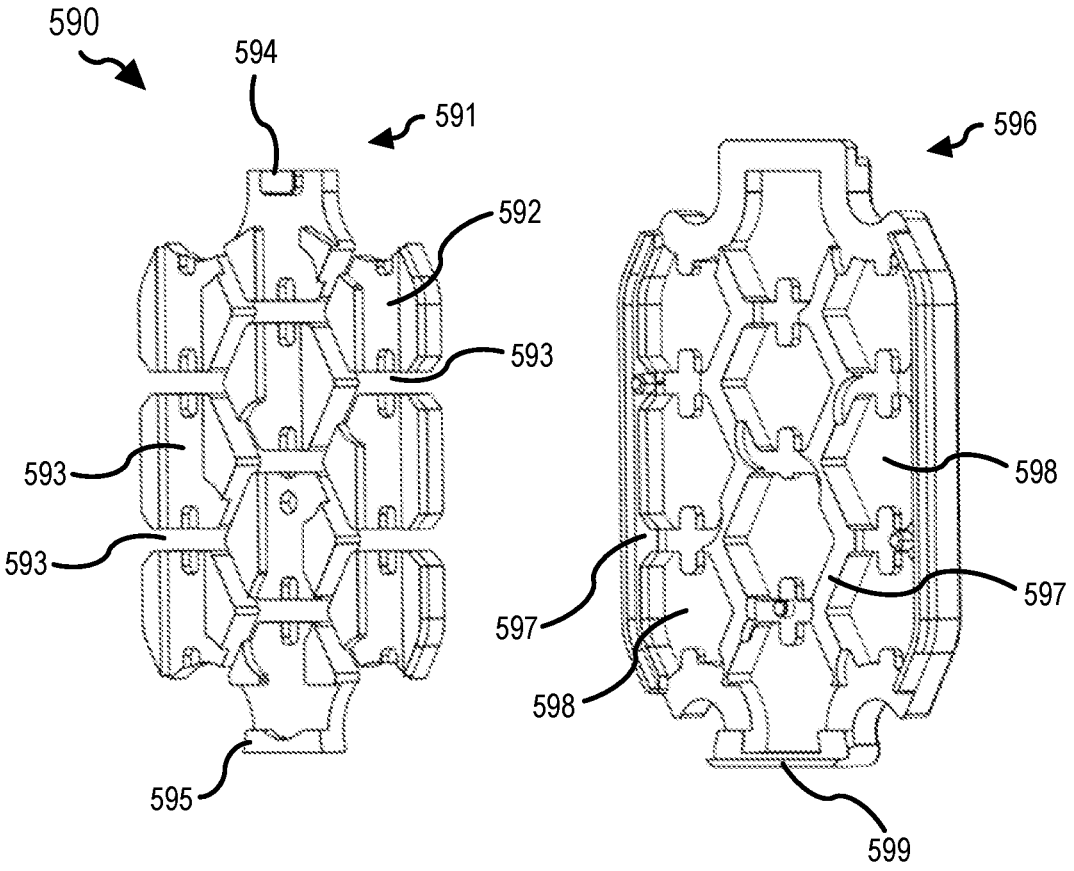
FIG. 5D is an exploded perspective view of an inner support for the interposer assembly of FIGS. 5A-5D, in accordance with various embodiments.

In various embodiments, and with reference to FIGS. 4A-4C, an interposer 400 is disclosed. Interposer 400 may be similar to any other interposer disclosed herein. Interposer 400 may comprise a body having a first end 460 opposite a second end 465. First end 460 may comprise an open end of interposer 400 configured to receive a magazine. Second end 465 may comprise an end surface (e.g., flat surface, platform, etc.) of interposer 400. The body of interposer 400 may be sized and shaped to be received in a bay of a CEW handle. For example, interposer 400 may be coupled within the bay of a CEW handle. In response to a magazine being inserted into the bay of the CEW handle, interposer 400 may interface and couple with the magazine. As a further example, interposer 400 may be coupled to a magazine and insertable together with the magazine into the bay of a CEW handle. In that regard, in response to the magazine being inserted into the bay of the CEW handle, interposer 400 may interface with one or more electrical and/or mechanical components within the bay.

In various embodiments, first end 460 may define a magazine seal 461. Magazine seal 461 may comprise an outer edge of interposer 400 protruding axially outward from second end 465. Magazine seal 461 may be configured to receive a magazine. Magazine seal 461 may be sized and shaped to receive a magazine and seal against an outer edge of the magazine. For example, and with reference again to FIG. 3B, second end 352 of magazine 312 may comprise an open end exposing one or more ends of cartridges 355 loaded into magazine 312. Interposer 400 may couple to (e.g., interface with, engage, etc.) second end 352 of magazine 312 such that the one or more ends of cartridges 355 are no longer exposed. Interposer 400 may couple to (e.g., interface with, engage, etc.) second end 352 of magazine 312 such that each cartridge 355 abuts against (or is positioned within) a cartridge compartment 470, as discussed further herein.

In various embodiments, an inner surface of magazine seal 461 may also be configured to receive, align, and/or contact one or more cartridges of a magazine, in response to the magazine being coupled to interposer 400. For example, cartridges located proximate the outer surface of a magazine may contact the inner surface of magazine seal 461. In some embodiments, the inner surface of magazine seal 461 may be sized and shaped to receive these cartridges. In that respect, the inner surface may comprise one or more axial grooves sized and shaped to receive a body and/or an end of a cartridge.

With reference again to FIGS. 4A-4C, and in accordance with various embodiments, interposer 400 may comprise a cartridge separator 467 defining one or more cartridge compartments 470. In various embodiments, cartridge separator 467 may comprise a physical structure that physically defines and separates one or more cartridge compartments 470 (e.g., as depicted). In various embodiments, cartridge separator 467 may be logically defined and may not comprise a physical structure. For example, an interposer may comprise one or more separated cartridge compartments. Each cartridge compartment may be logically separated into a discrete and unitary cartridge compartment without a physical structure physically defining each cartridge compartment. In that regard, each cartridge compartment may be logically separated by a cartridge separator without the need for a physical structure (i.e., a physical cartridge separator).

A cartridge compartment 470 may be configured to receive and align with a cartridge loaded into a magazine. In that regard, one or more cartridge compartments 470 may be sized, shaped, and oriented to receive cartridges from magazines having similarly oriented cartridges, in response to the magazine being coupled to the interposer. For example, in response to a magazine being coupled to interposer 400, a first cartridge compartment may align with and receive a first cartridge, a second cartridge compartment may align with and receive a second cartridge, a third cartridge compartment may align with and receive a third cartridge, and so forth.

In some embodiments, interposer 400 may have a number of cartridge compartments equal to, or the same as, a number of cartridges a compatible magazine is configured to receive. In some embodiments, interposer 400 may have a number of cartridge compartments different than a number of cartridges a compatible magazine is configured to receive. For example, an interposer may comprise a number of cartridge compartments less than the number of cartridges a compatible magazine is configured to receive.

In some embodiments, interposer 400 may have a number of cartridge compartments 470 that is at least equal to a number of cartridges capable of being received into a magazine. For example, in some embodiments an exemplary interposer may comprise ten cartridge compartments (e.g., as depicted in FIGS. 4A-4C). The exemplary interposer may be configured to interface with an exemplary magazine capable of receiving up to ten cartridges. For example, a first magazine having ten cartridges may interface with the exemplary interposer such that each of the ten cartridge compartment receives a single cartridge from the magazine. As a further example, a second magazine having four cartridges (e.g., as depicted in FIGS. 3A and 3B) may interface with the exemplary interposer such that four of the ten cartridge compartments receive a single cartridge from the magazine.

As a further example, in some embodiments, a cartridge compartment 470 may also be configured to receive and align with a plurality of cartridges. For example, an exemplary interposer may comprise five cartridge compartments. The exemplary interposer may be configured to interface with an exemplary magazine capable of receiving up to ten cartridges. In that regard, each cartridge compartment may be configured to receive and align with at least two cartridges.

In various embodiments, cartridge separator 467 may comprise any suitable size, shape, and dimension capable of defining one or more cartridge compartments 470. In various embodiments, cartridge separator 467 may define (e.g., physically and/or logically separate) one or more of the cartridge compartments 470 based on changes or differences in materials, dividing lines or drawings, protrusions, valleys, and/or the like.

In various embodiments, cartridge separator 467 may physically define the one or more cartridge compartments 470. For example, cartridge separator 467 may comprise one or more protrusions, ridges, or the like defining the one or more cartridge compartments 470. As a further example, cartridge separator 467 may comprise one or more axial protrusions defining the one or more cartridge compartments 470.

In various embodiments, a cartridge compartment 470 may comprise any suitable size, shape, and/or surface area. A cartridge compartment 470 may comprise any suitable size, shape, and/or surface area configured to receive a cartridge. For example, a cartridge compartment 470 may comprise a circular shape, a square shape, a hexagonal or honeycomb shape, and/or the like. A cartridge compartment 470 may comprise a size and/or surface area larger than an end of a cartridge, such that the cartridge compartment 470 may receive the end of a cartridge. A cartridge compartment 470 may define a portion of the body of interposer 400.

In various embodiments, each cartridge compartment 470 may comprise a first interposer insert 476 and a second interposer insert 478. First interposer insert 476 may define a first portion of a cartridge compartment 470. Second interposer insert 478 may define a second portion of a cartridge compartment 470. First interposer insert 476 may be different from second interposer insert 478. For example, first interposer insert 476 may comprise different dimensions, physical properties, materials, and/or the like compared to second interposer insert 478. First interposer insert 476 may surround and/or define second interposer insert 478.

In some embodiments, first interposer insert 476 and second interposer insert 478 may be part of a same component. In some embodiments, first interposer insert 476 and second interposer insert 478 may each be part of separate components. In some embodiments, first interposer insert 476 and/or second interposer insert 478 may be discrete components.

In various embodiments, second interposer insert 478 may be sized and shaped to receive an end of a cartridge. For example, second interposer insert 478 may be sized and shaped similar to the end of the cartridge (e.g., a circular shape, a partially circular shape, a semi-circular shape, etc.). In response to interposer 400 receiving or being coupled to a magazine having one or more loaded cartridges, a second interposer insert 478 may abut (e.g., contact, couple to, etc.) against the end of a loaded cartridge (e.g., second interposer insert 478 may comprise a cartridge stop).

Second interposer insert 478 may comprise a material configured to at least partially receive a recoil force from a cartridge responsive to deployment of the cartridge. For example, second interposer insert 478 may comprise a metallic material, such as stainless zinc, diecast zinc, other metal alloy, or the like. Second interposer insert 478 may comprise varying dimensions, properties, and/or shapes. For example, second interposer insert 478 may vary in width in an axially forward to axially aft direction (e.g., a flared shape). In that regard, an axially forward surface of second interposer insert 478 (e.g., the surface configured to receive a cartridge end) may comprise a smaller width and/or surface area compared to an axially aft surface of second interposer insert 478. Varying the width of second interposer insert 478 in this manner may maximize a surface area of second interposer insert 478 to better distribute a recoil force.

In various embodiments, first interposer insert 476 may comprise a non-conductive material. For example, first interposer insert 476 may comprise a rubber material, a plastic material, and/or the like. In that regard, first interposer insert 476 may electrically isolate each second interposer insert 478. Electrically isolating each second interposer insert 478 may at least partially reduce electrical shorting between cartridges contacting a second interposer insert 478.

In some embodiments, first interposer insert 476 may comprise a single continuous object. In that regard, each cartridge compartment 470 may comprise different second interposer inserts but a same first interposer insert. For example, a first cartridge compartment may comprise a first cartridge compartment first interposer insert and a first cartridge compartment second interposer insert and a second cartridge compartment may comprise a second cartridge compartment first interposer insert and a second cartridge compartment second interposer insert. The first cartridge compartment first interposer insert and the second cartridge compartment first interposer insert may be the same object, whereas the first cartridge compartment second interposer insert and the second cartridge compartment second interposer insert are different objects.

In some embodiments, one or more of the first interposer inserts 476 may comprise separate objects, or may be separated from other first interposer inserts 476 by each cartridge compartment 470.

In various embodiments, each cartridge compartment 470 may also comprise one or more electrical components configured to provide electrical signals to cartridges received by each cartridge compartment. For example, each cartridge compartment 470 may comprise one or more electrical connectors such as a pogo pin, a spring-loaded pin, an electrical contact, an electrical probe, and/or the like. Each cartridge compartment 470 may comprise electrical connectors configured to provide ignition signals to cause deployment of a cartridge received in a cartridge compartment 470. Each cartridge compartment 470 may comprise electrical connectors configured to provide stimulus signals to electrodes deployed from a cartridge received in a cartridge compartment 470.

For example, a cartridge compartment 470 may comprise a signal pin 472. Signal pin 472 may be positioned within a cartridge compartment and configured to provide an electrical signal to an end of a cartridge received in cartridge compartment 470. Signal pin 472 may be located at a center point within cartridge compartment 470 and may be configured to electrically couple to an electrical contact on a center point of an end of a cartridge. Signal pin 472 may be at least partially surrounded by second interposer insert 478. Signal pin 472 may be electrically isolated from second interposer insert 478 by first interposer insert 476.

As a further example, a cartridge compartment 470 may comprise a ground pin 474. In some embodiments, ground pin 474 may be positioned within a cartridge compartment and configured to provide an electrical signal to an end of a cartridge received in cartridge compartment 470. In some embodiments, ground pin 474 may be positioned within a cartridge compartment 470 and configured to provide electrical grounding. Ground pin 474 may be located radially outward from signal pin 472 in a cartridge compartment 470. Ground pin 474 may be electrically isolated from second interposer insert 478 by first interposer insert 476. In some embodiments, second interposer insert 478 may comprise a shape having a broken circle with a first end and a second end. Ground pin 474 may be located between the first end and the second end of the broken circle (e.g., as depicted in FIGS. 4A-4C). First interposer insert 476 may define an outer surface of the broken circle, and an inner surface of the broken circle (e.g., first interposer insert 476 may be radially inward and radially outward second interposer insert 478).

Signal pin 472 may be configured to contact a cartridge at a first location on the cartridge and ground pin 474 may be configured to contact the cartridge at a second location on the cartridge. The first location may be radially inward from the second location. The first location may comprise a substantially center location on an end of the cartridge. The second location may comprise an outer edge of an end of the cartridge.

In various embodiments, signal pin 472 and/or ground pin 474 may be electrically coupled to (directly or in series) one or more components of a CEW handle, such as, for example, a processing circuit, a signal generator, and/or a power supply. For example, in embodiments where interposer 400 is coupled within a bay of a CEW handle, signal pin 472 and/or ground pin 474 may be electrically coupled to the one or more components, and in response to a magazine being inserted into the bay and coupled to interposer 400, signal pin 472 and/or ground pin 474 may electrically couple to one or more cartridges positioned within the magazine. As a further example, in embodiments where interposer 400 is first coupled to a magazine before being inserted into a bay of a CEW handle, signal pin 472 and/or ground pin 474 may electrically couple to the one or more components in response to the magazine and interposer 400 being inserted into the bay.

In various embodiments, one or more components of interposer 400 may comprise a monolithic structure (e.g., a single structure, a unitary structure, etc.). For example, cartridge separator 467 and first interposer insert 476 may comprise a monolithic structure. As a further example, cartridge separator 467 and magazine seal 461 (and/or a body of interposer 400) may comprise a monolithic structure. As a further example, at least two of cartridge separator 467, a body of interposer 400, and/or first interposer insert 476 may comprise a monolithic structure. The monolithic structure may comprise a single material type. The monolithic structure may comprise a mix of one or more material types. In other embodiments, each component of interposer 400 as described previously herein may comprise separate components and/or structures.

In various embodiments, an interposer may also be part of an interposer assembly for a CEW. For example, in accordance with various embodiments and with reference to FIGS. 5A-5D, an interposer assembly 502 is disclosed. Interposer assembly 502 may comprise an interposer (e.g., interposer 400) and an interposer support 501. An interposer in interposer assembly 502 may be similar to any other interposer disclosed herein.

In various embodiments, interposer support 501 may be configured to couple to second end 465 of interposer 400. Interposer support 501 may be configured to provide mechanical, electrical, and/or electronic support and/or capabilities to interposer 400. Interposer support 501 may be configured to at least partially receive a recoil force in response to a cartridge deployment from a magazine coupled to interposer 400. For example, in response to a cartridge deployment the cartridge may transfer a recoil force to a second interposer insert of interposer 400. The second interposer insert may (at least partially) transfer the recoil force to interposer support 501. Interposer support 501 may comprise a support bracket 580 and an inner support 590.

In various embodiments, support bracket 580 may comprise a contact surface 581 configured to couple to second end 465 of interposer 400. Contact surface 581 may define one or more slots 586 comprising openings in contact surface 581. Contact surface 581 may comprise one or more mechanical features configured to couple support bracket 580 to inner support 590 and/or interposer 400. For example, contact surface 581 may comprise a first coupling point 587 and a second coupling point 588. First coupling point 587 may couple to a retaining mechanism of inner support 590 (e.g., first retaining mechanism 594). First coupling point 587 may comprise a slot or opening configured to receive a protrusion of inner support 590. Second coupling point 588 may couple to one or more retaining mechanisms of inner support 590 (e.g., second retaining mechanism 595, third retaining mechanism 599, etc.). Second coupling point 588 may comprise a protrusion or surface extension configured to mechanically interface with the one or more retaining mechanisms of inner support 590. Contact surface 581 may also comprise a mounting platform 585. Mounting platform 585 may be configured to mount or extend internally within a CEW handle.

Support bracket 580 may comprise electrical and/or electronic circuitry to enable electrical coupling between one or more of the electrical pins of interposer 400 (e.g., signal pins 472, ground pins 474, etc.) and one or more electrical and/or electronic components of a CEW handle, such as a processing unit, a signal generator, and/or a power supply. For example, support bracket 580 may comprise an electronic or electrical interface such as a physical interface card (PIC), a flexible PIC concentrator (FPC), a digital interface card (DIC), a bus, and/or the like. Mounting platform 585 may be configured to electrically and/or electronically couple support bracket 580 to the one or more electrical and/or electronic components of a CEW handle.

Support bracket 580 may comprise one or more mounting locations configured to mount and electrically couple to one or more electrical connectors of interposer 400. For example, contact surface 581 may define one or more signal pin mounts 582 and/or one or more ground pin mounts 584. Each signal pin mount 582 and/or ground pin mount 584 may be aligned with a cartridge compartment in response to support bracket 580 being coupled to interposer 400. Signal pin mount 582 may be configured to receive and couple to a signal pin 472. Signal pin mount 582 may mechanically, electrically, and/or electronically couple to a signal pin 472. Ground pin mount 584 may be configured to receive and couple to a ground pin 474. Ground pin mount 584 may mechanically, electrically, and/or electronically couple to a ground pin 474.

In various embodiments, inner support 590 may be configured to couple to support bracket 580 and/or interposer 400. Inner support 590 may comprise a cartridge portion support 591 and a separator support 596.

Cartridge portion support 591 may be sized and shaped similar to the cartridge compartments 470 of interposer 400. Cartridge portion support 591 may be configured to at least partially receive a recoil force from a second interposer support of interposer 400 (e.g., in response to a cartridge deployment from a magazine coupled to interposer 400). Cartridge portion support 591 may comprise a material configured to receive the recoil force, such as a foam gasket, a plastic, a rubber, and/or the like.

Cartridge portion support 591 may comprise a support platform 592 defining one or more slots 593. The one or more slots 593 may be configured to receive separator support 596, as discussed further herein. Support platform 592 may comprise one or more mechanical features configured to couple cartridge portion support 591 to support bracket 580 and/or separator support 596. For example, support platform 592 may comprise a first retaining mechanism 594 and/or a second retaining mechanism 595. First retaining mechanism 594 may be configured to couple to a coupling point of support bracket 580 (e.g., first coupling point 587). For example, first retaining mechanism 594 may comprise a protrusion configured for insertion into a slot or opening of support bracket 580. Second retaining mechanism 595 may be configured to couple to a coupling point of support bracket 580 (e.g., second coupling point 588) and/or to a retaining mechanism of separator support 596 (e.g., third retaining mechanism 599). For example, second retaining mechanism 595 may be sized and shaped on an inner edge to receive second coupling point 588. Second retaining mechanism 595 may be sized and shaped on an outer edge to be received by third retaining mechanism 599. The interface between second coupling point 588, second retaining mechanism 595, and third retaining mechanism 599 may couple together each of support bracket 580, cartridge portion support 591, and separator support 596.

Separator support 596 may be configured to at least partially define and/or surround cartridge portion support 591. Separator support 596 may comprise a border 597 defining one or more openings 598. Border 597 may be configured to be received into slots 593 of cartridge portion support 591. Border 597 may also at least partially define and surround an outer border of support platform 592 of cartridge portion support 591. Border 597 may comprise a rigid material configured to enclose cartridge portion support 591. Openings 598 may be sized and shaped to receive support platform 592.

Separator support 596 may comprise one or more mechanical features configured to couple separator support 596 to support bracket 580 and/or cartridge portion support 591. For example, separator support 596 may comprise a third retaining mechanism 599 configured to interface with a coupling point of support bracket 580 (e.g., second coupling point 588) and/or a retaining mechanism of cartridge portion support 591 (e.g., second retaining mechanism 595). For example, third retaining mechanism 599 may be sized and shaped to receive an outer edge of second retaining mechanism 595 of cartridge portion support 591. As previously discussed, second retaining mechanism 595 may be sized and shaped on an inner edge to receive second coupling point 588. The interface between second coupling point 588, second retaining mechanism 595, and third retaining mechanism 599 may couple together each of support bracket 580, cartridge portion support 591, and separator support 596.

In various embodiments, an interposer for a conducted electrical weapon may comprise a body comprising a first end opposite a second end, wherein the first end defines an opening; a cartridge separator disposed within the opening of the body; and a plurality of cartridge compartments, wherein each cartridge compartment of the plurality of cartridge compartments is defined by the cartridge separator, and wherein each cartridge compartment of the plurality of cartridge compartments is configured to receive an end of a cartridge.

In various embodiments, each cartridge compartment of the plurality of cartridge compartments comprises a first interposer insert and a second interposer insert. The first interposer insert surrounds and defines the second interposer insert. The second interposer insert is sized and shaped similar to the end of the cartridge. At least two of the cartridge separator, the body, and the first interposer insert comprise a monolithic structure. The first end of the body comprises a magazine seal configured to couple to a magazine containing the cartridge. The interposer may further comprise a plurality of signal pins, wherein each signal pin of the plurality of signal pins is positioned within a cartridge compartment of the plurality of cartridge compartments, and wherein each signal pin of the plurality of signal pins is configured to provide an electrical signal to the end of the cartridge received in the cartridge compartment of the plurality of cartridge compartments. Each signal pin of the plurality of signal pins is located at a center point within the cartridge compartment of the plurality of cartridge compartments. The interposer may further comprise a plurality of ground pins, wherein each ground pin of the plurality of ground pins is positioned within a cartridge compartment of the plurality of cartridge compartments.

In various embodiments, a conducted electrical weapon (CEW) may comprise a handle defining a bay and an interposer. The interposer may be coupled to an inner surface of the bay. The interposer may comprise a body comprising a first end opposite a second end, wherein the first end defines an opening; a cartridge separator disposed within the opening of the body; and a plurality of cartridge compartments, wherein each cartridge compartment of the plurality of cartridge compartments is defined by the cartridge separator, and wherein each cartridge compartment of the plurality of cartridge compartments is configured to receive an end of a cartridge.

In various embodiments, the CEW may further comprise a magazine removably insertable within the bay, wherein in response to the magazine being inserted into the bay the magazine is configured to couple to the interposer. The magazine is configured to house the cartridge, and wherein in response to the magazine being inserted into the bay the end of the cartridge is received by a cartridge compartment of the plurality of cartridge compartments. The CEW may further comprise a signal generator disposed within the handle, wherein the interposer is electrically coupled to the signal generator, and wherein the interposer is configured to provide an electrical signal to the cartridge. In response to the magazine being removed from the bay the interposer remains coupled to the inner surface of the bay.

In various embodiments, an interposer assembly for a conducted electrical weapon may include an interposer and an interposer support. The interposer may comprise an opening defined by a first end and a second end of the interposer, wherein the opening is configured to receive a magazine; and a cartridge separator disposed within the opening of the interposer, wherein the cartridge separator defines a plurality of cartridge compartments. The interposer support may be coupled to the second end of the interposer, the interposer support comprising a cartridge portion support sharing a size and shape similar to each cartridge compartment of the plurality of cartridge compartments.

In various embodiments, the interposer support may further comprise a support bracket configured to couple the interposer support to the second end of the interposer; and a separator support coupled to the support bracket, wherein the separator support defines and surrounds the cartridge portion support. The interposer may further comprise a plurality of signal pins, wherein each signal pin of the plurality of signal pins is positioned within a cartridge compartment of the plurality of cartridge compartments. The interposer support may further comprise a support bracket configured to couple the interposer support to the second end of the interposer, wherein the support bracket comprises a plurality of signal pin mounts configured to provide each signal pin from the plurality of signal pins to each cartridge compartment of the plurality of cartridge compartments. Each cartridge compartment of the plurality of cartridge compartments is sized and shaped to receive an end of a cartridge in the magazine. Each cartridge compartment of the plurality of cartridge compartments comprises a first interposer insert and a second interposer insert, and wherein the second interposer insert and the interposer support are configured to receive a recoil force in response to the cartridge being deployed from the magazine.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosures. The scope of the disclosure is accordingly to be limited by nothing other than the appended claims and their legal equivalents, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B, and C may be present in a single embodiment; for example, A and B, A and C, B and C, or A and B and C.

Systems, methods, and apparatus are provided herein. In the detailed description herein, references to "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments. Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. An interposer for a conducted electrical weapon comprising:

a plurality of cartridge compartments, wherein each cartridge compartment of the plurality of cartridge compartments is configured to receive an end of a cartridge;

a plurality of signal pins, wherein each signal pin of the plurality of signal pins is positioned within a respective cartridge compartment of the plurality of cartridge compartments and configured to contact the end of the cartridge; and a plurality of ground pins, wherein each ground pin of the plurality of ground pins is positioned within the respective cartridge compartment of the plurality of cartridge compartments and configured to contact the end of the cartridge.

2. The interposer of claim 1, wherein each signal pin of the plurality of signal pins is configured to contact the end of the cartridge at a first location, wherein each ground pin of the plurality of ground pins is configured to contact the end of the cartridge at a second location, and wherein the first location is different from the second location.

3. The interposer of claim 2, wherein the first location is radially inward from the second location.

4. The interposer of claim 2, wherein the first location comprises a center location on the end of the cartridge, and wherein the second location comprises an outer edge of the end of the cartridge.

5. The interposer of claim 1, wherein each ground pin of the plurality of ground pins is located radially outward from each signal pin of the plurality of signal pins within the respective cartridge compartment of the plurality of cartridge compartments.

6. The interposer of claim 1, wherein each cartridge compartment of the plurality of cartridge compartments comprises a first interposer insert and a second interposer insert, wherein each signal pin of the plurality of signal pins is electrically isolated from the second interposer insert by the first interposer insert, and wherein each ground pin of the plurality of ground pins is electrically isolated from the second interposer insert by the first interposer insert.

7. The interposer of claim 1, wherein a number of cartridge compartments of the plurality of cartridge compartments is at least equal to a number of cartridges a compatible magazine is configured to receive.

8. The interposer of claim 7, wherein each cartridge compartment of the plurality of cartridge compartments comprises a single signal pin of the plurality of signal pins and a single ground pin from the plurality of ground pins.

9. The interposer of claim 7, wherein each cartridge compartment of the plurality of cartridge compartments is configured to receive and provide electrical coupling to a separate cartridge from the compatible magazine.

10. A handle for a conducted electrical weapon comprising:

a bay configured to receive a magazine; and an interposer coupled to an inner surface of the bay, wherein the interposer comprises:

a cartridge compartment;

a signal pin positioned within the cartridge compartment at a first location within the cartridge compartment; and a ground pin positioned with the cartridge compartment at a second location within the cartridge compartment, wherein the first location is radially inward from the second location.

11. The handle of claim 10, further comprising a signal generator, wherein the interposer is electrically coupled to the signal generator, and wherein the interposer is configured to provide an electrical signal from the signal generator.

12. The handle of claim 11, wherein the signal pin is configured to provide the electrical signal, and wherein the ground pin is configured to provide electrical grounding.

13. The handle of claim 10, wherein the cartridge compartment is configured to align with a bore of the magazine in response to the bay receiving the magazine.

14. The handle of claim 13, wherein the signal pin and the ground pin are configured to electrically couple to a cartridge disposed within the bore of the magazine in response to the bay receiving the magazine.

15. The handle of claim 14, wherein the signal pin is configured to contact the cartridge at a center location on an end of the cartridge, and wherein the ground pin is configured to contact the cartridge at an outer edge of the end of the cartridge.

16. A conducted electrical weapon comprising:

a handle defining a bay;

a magazine configured to removably couple to the bay; and an interposer configured to provide electrical coupling between the handle and the magazine, wherein the interposer comprises:

a cartridge compartment;

a signal pin positioned within the cartridge compartment at a first location within the cartridge compartment; and a ground pin positioned with the cartridge compartment at a second location within the cartridge compartment, wherein the first location is radially inward from the second location.

17. The conducted electrical weapon of claim 16, wherein the signal pin is located at a center point within the cartridge compartment.

18. The conducted electrical weapon of claim 16, wherein the interposer is disposed within the bay of the handle, and wherein the interposer is configured to provide electrical coupling to a cartridge housed in the magazine in response to the magazine being coupled to the bay of the handle.

19. The conducted electrical weapon of claim 16, wherein the interposer is configured to couple to the magazine prior to the magazine being coupled to the bay of the handle.

20. The conducted electrical weapon of claim 16, wherein the cartridge compartment is sized and shaped to align with a bore of the magazine.

* * * * *